United States Patent [19]

Yarpezeshkan

[11] Patent Number: 4,725,804

[45] Date of Patent: Feb. 16, 1988

[54] ELECTROSTATIC FORK SHIELD

[75] Inventor: Hassan Yarpezeshkan, San Diego, Calif.

[73] Assignee: Square D Company, Palatine, Ill.

[21] Appl. No.: 882,219

[22] Filed: Jul. 3, 1986

Related U.S. Application Data

[63] Continuation of Ser. No. 613,552, May 24, 1984, abandoned.

[51] Int. Cl.[4] ..... H01F 33/00; H01F 15/04

[52] U.S. Cl. ..... 336/5; 336/84 C

[58] Field of Search ..... 336/5, 10, 12, 84 C, 336/84 R, 184

[56] References Cited

U.S. PATENT DOCUMENTS

| | | | |
|---|---|---|---|
| 2,114,189 | 4/1938 | Kronmiller | 336/84 C |
| 2,170,048 | 8/1939 | Dunning et al. | 336/84 C X |
| 2,183,355 | 12/1939 | Mauerer | 336/84 C |
| 2,914,719 | 11/1959 | Walton et al. | 336/84 C X |
| 2,937,349 | 5/1960 | Camilli | 336/84 C X |
| 3,142,029 | 7/1964 | Keen, Jr. et al. | 336/84 C |
| 3,265,998 | 8/1966 | Park | 336/84 C |
| 3,277,416 | 10/1966 | Barr | 336/84 C |
| 3,353,129 | 11/1967 | Leibinger | 336/84 C X |
| 4,176,334 | 11/1979 | Buritz et al. | 336/84 C |
| 4,333,900 | 6/1982 | Carey | 336/84 C X |

*Primary Examiner*—Thomas J. Kozma

*Attorney, Agent, or Firm*—Mary R. Jankousky; Thomas B. Lindgren; Richard T. Guttman

[57] ABSTRACT

An electrostatic fork shield for a layer wound transformer yielding a high degree of noise attenuation. A three phase transformer has three leg portions which are interconnected at both ends by a yoke. Around each leg portion is wound layers of primary coil and secondary coil. The transformer core, coils and shields lie within an enclosure. Both the inner wall and outer wall of each transformer coil is covered with a non-ferrous conductive shield. Between the primary and secondary coils of each phase and their respective vertical shields, is interposed a glastic spacer. A horizontal shield lies across each end of the transformer coil. The horizontal shield comprises a base and inner and outer fingers which cover a large portion of the surface of the coil ends but do not form a complete electric path around any leg portion. Two barrier shields are located on one side of the transformer between adjacent phases and are connected to the inner fingers of each horizontal shield. The barrier shields contact the outermost vertical shield of adjacent phases. Side shields are received in separate slots in the base portion of the horizontal shields. One side shield also provides support for the shield ground wire connected to both horizontal shields, the side shield and the transformer ground. Top shields and bottom shields block the space between the respective ends of the transformer coils and the nearby enclosure walls.

10 Claims, 3 Drawing Figures

ELECTROSTATIC FORK SHIELD

This application is a continuation of application Ser. No. 613,552, now abandoned, filed on May 24, 1984.

FIELD OF THE INVENTION

This invention relates to a method and apparatus for the electrostatic shielding of transformers, and more particularly to such a method and apparatus producing a high degree of noise attenuation.

DESCRIPTION OF PRIOR ART

Power taken from a typical AC power line is inherently noisy, due to factors such as switching transients, industrial machinery, and radio and television transmissions. Although this noise is insignificant in an average application, even a very small noise component may seriously affect the transmission, indication and recording of data. For this reason a high degree of noise attenuation is desirable for circuits used in precise measurement or control, digital data handling, or error-free communication of information.

In the past, it has been common to use a box shield surrounding each coil in a side-by-side transformer design to produce a relatively high degree of noise attenuation. A side-by-side design is impractical for use with a three phase transformer since it impairs transformer performance.

A three phase transformer often utilizes a layer wound design in which the primary coil is wound on top of the secondary coil around a leg portion of the core. One method of electrostatic shielding for such a layer wound design is to provide a Faraday shield or vertical box shield which surrounds the inner and/or outer diameter of each primary coil and each secondary coil. This arrangement, however, does not provide sufficient noise attenuation for the increasing demands of today's more sensitive equipment.

In addition to the lower frequency noise handled by the methods described above, a small percentage of users of equipment such as radar, communication equipment or microprocessors, must also attenuate a higher frequency RF noise. RF filters are available for this purpose for applications up to approximately 30 amps single phase. RF filters are presently not available for three phase applications or for high amp applications. As an alternative to these devices, the users may isolate their own equipment by placing the equipment in a separate aluminum box. This method is rather expensive.

A device is needed to provide a higher degree of noise attenuation in wide range of frequencies than is presently available.

SUMMARY OF THE INVENTION

It is an object of this invention to provide a method and apparatus for electrostatically shielding a layer wound electrical transformer.

It is a further object of this invention to provide a method and apparatus for electrostatically shielding a layer wound electrical transformer to provide greater noise attenuation than is presently available for a three phase system.

These objectives are achieved by the fork shield assembly of the present invention which shields a layer wound electrical transformer such as the three phase transformer described below. The transformer core, coils and shields described below are surrounded by an enclosure.

Vertical shields composed of a non-ferrous conductor, such as copper or aluminum, cover the inner and outer circumference of each primary coil and each secondary coil. A horizontal shield rests upon each end of the transformer coils. The horizontal shields each have a base located along one side of the coils, and inner and outer fingers which extend parallel to the width of the core leg portion to the opposite side of the coils. The horizontal shield is formed of a non-ferrous conductor and has a layer of insulation on both sides.

On one side of the transformer between the coils of the three phases are located barrier shields. Each barrier shield includes an extension approximately equal to the length of the coils, a lip running along the complete length of both sides of the extension, with a tab at each end of the extension. Each tab has an opening which is mated with a groove located at the end of the inner fingers of the horizontal shield. The horizontal shield and barrier shields are secured to each other by a bolt placed through the opening and groove and a nut tightened onto the bolt.

On both sides of each horizontal shield base portion, adjacent the outer fingers, is a slot adapted to receive the thickness of a side shield which comprises a rectangular strip of a non-ferrous conductor. One side shield also supports the ground wire which is connected to both horizontal shields.

The invention also includes a top shield positioned on each side of the core between the top end of the transformer coils and the top of the enclosure. The top shields extend from one wall of the enclosure to the opposite wall. Two bottom shields are positioned in a similar manner with regard to the opposite end of the transformer core and coils.

The foregoing and other objects, features and advantages of this invention will become apparent from the following more particular description of the preferred embodiment together with the accompanying drawings and claims.

DESCRIPTION OF THE PREFERRED EMBODIMENT

Figure 1:
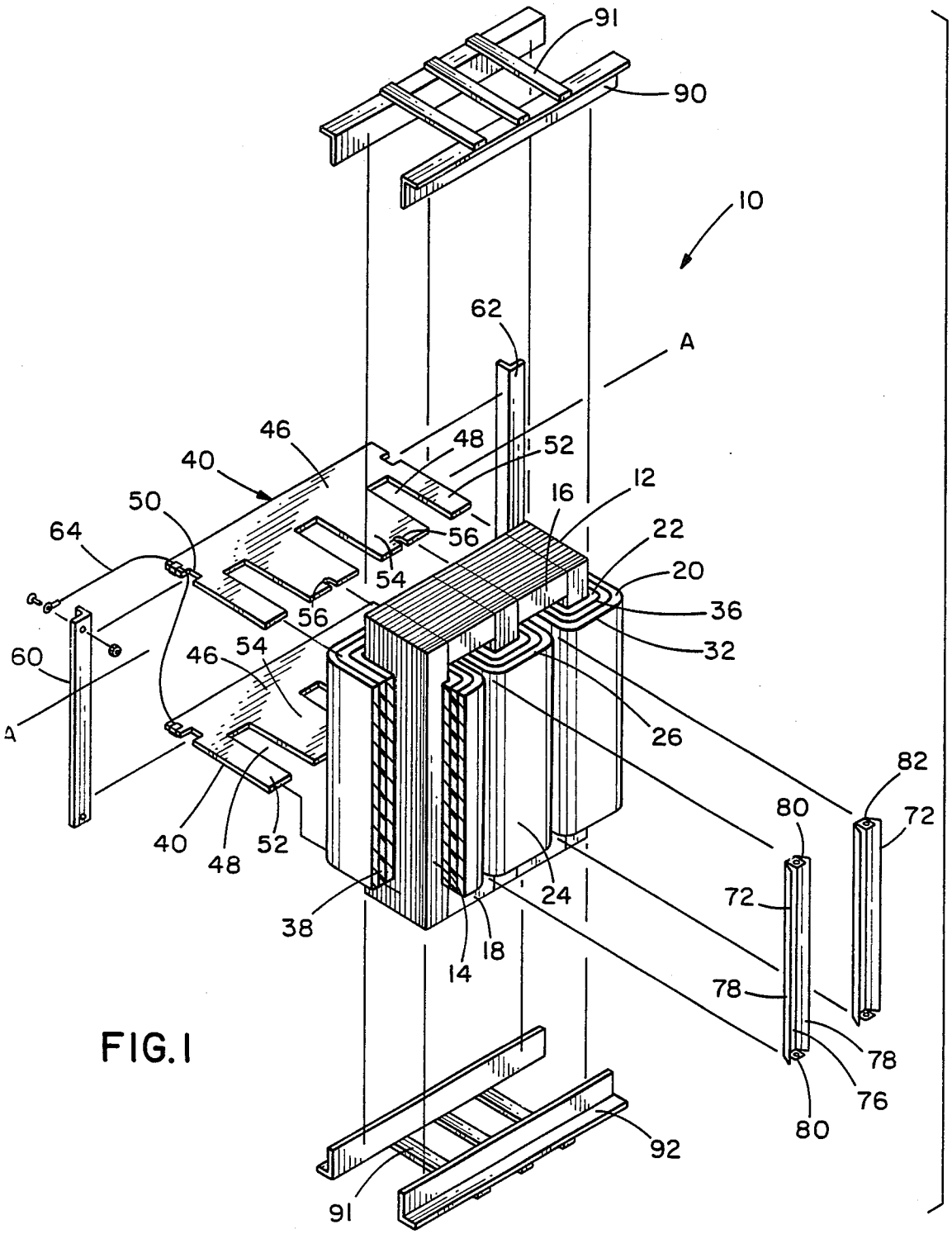
FIG. 1 is an exploded perspective view of a transformer in accordance with the present invention.

Referring now to the drawings, and particularly to FIG. 1 thereof, the entire assembly is indicated generally by the reference character 10. The preferred embodiment will be discussed below with reference to a three phase transformer. However, the invention may also be used with other transformers of a layer wound design.

Figure 2:
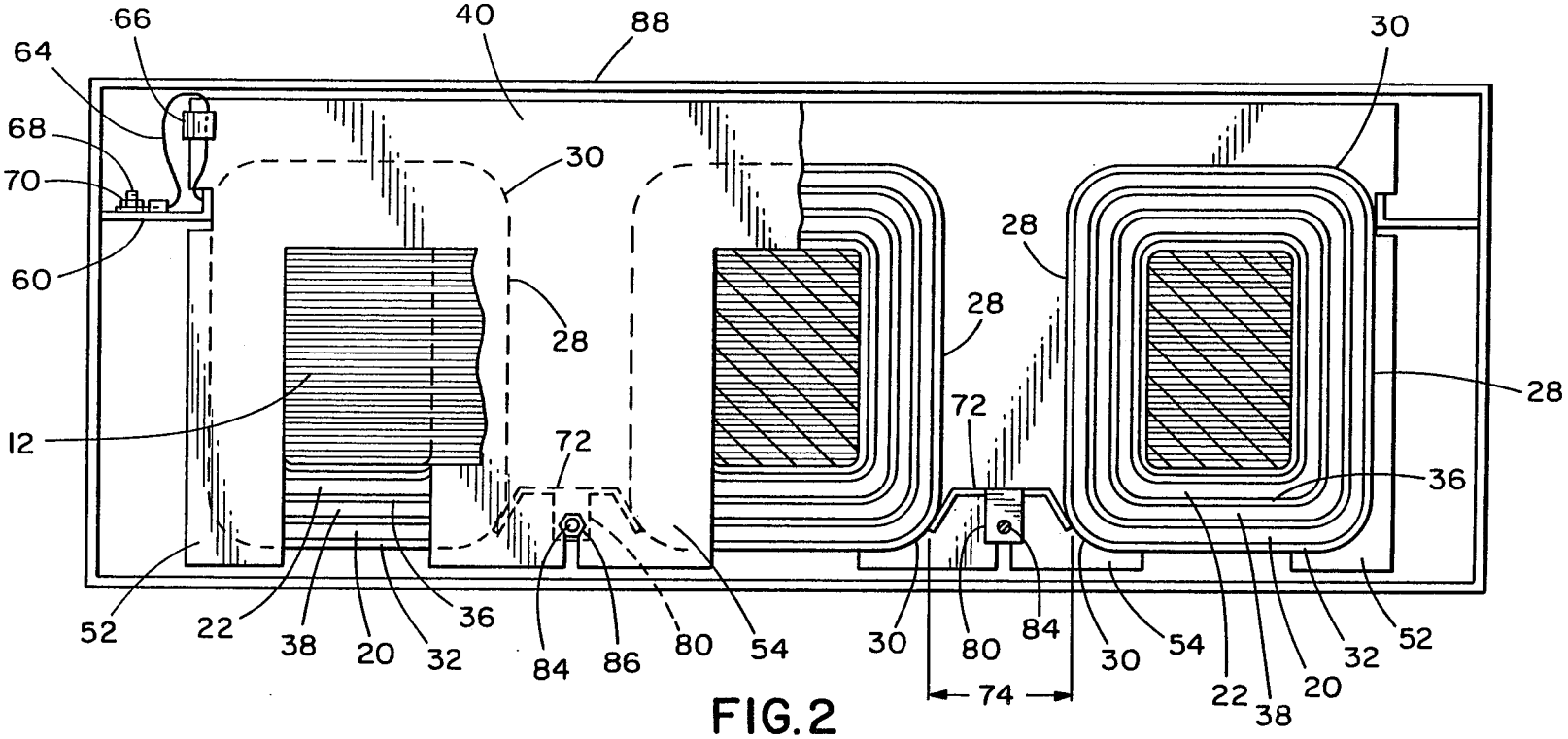
FIG. 2 is a partial top view of an assembled transformer in accordance with the present invention with the top shield and straps removed.

The preferred embodiment includes laminated ferrous core 12, comprising three approximately parallel leg portions 14 joined at the ends by top yoke portion 16 and bottom yoke portion 18. Around each leg portion 14 is primary coil 20 wound on top of secondary coil 22. A transformer normally includes many layers of shields and insulation, and may even include multiple layers of a primary coil or secondary coil. Shown in FIG. 2 are layers representative of a transformer design. Different applications may require different numbers and arrangements of the various layers. Note that FIG. 2 does not show the layers of insulation which may be disposed between adjacent layers. The electrical connections and other particulars regarding the transformer coils may be performed in any manner taught by the prior art.

Each primary coil 20 and each secondary coil 22 has an approximate cylindrical shape with longitudinal wall 24, axis 25 and two open ends 26. Wall 24 of each transformer coil comprises four approximately flat sides 28 with curved corners 30 between adjacent sides as shown in FIG. 2. Each primary coil 20 is enveloped by a primary vertical shield 32 and each secondary coil 22 is enveloped by a secondary vertical shield 36. Unless otherwise specified, the shields used in this invention are comprised of a non-ferrous conductor, such as copper or aluminum. Vertical shields 32 and 36 cover both the inside and outside of walls 24 of primary coils 20 and secondary coils 22, respectively. Leg portions 14, extending approximately parallel to one another, are spaced apart such that primary vertical shields 32 of adjacent phases do not touch one another. Between the inner vertical shields of primary coils 20 and the outer vertical shields of secondary coils 22 are disposed glastic spacers 38 which promote air flow to cool the transformer coils.

Figure 3:
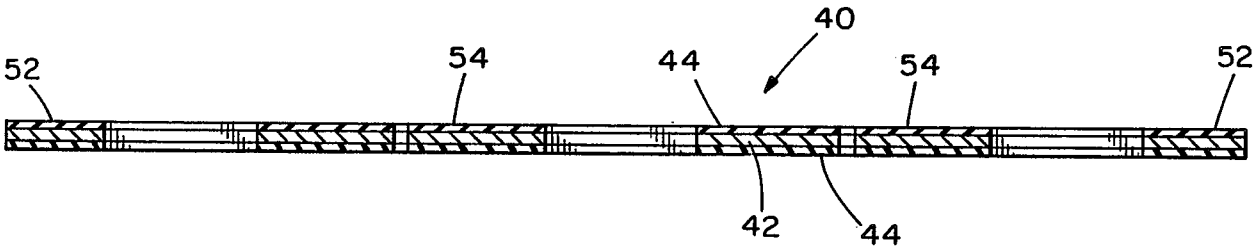
FIG. 3 is a partial sectional of the horizontal shield as shown in FIG. 1 along line A—A.

Horizontal shields 40 are positioned adjacent both ends of the transformer coils, generally perpendicular to axes 25 of primary coils 20 and secondary coils 22. Horizontal shields 40 comprise a non-ferrous conductor plate 42 covered on both sides with insulation 44, as seen in FIG. 3. Each horizontal shield 40 comprises base portion 46 which extends along one edge of the transformer coil end in a direction parallel to the top yoke portion 16. Each horizontal shield 40 also includes two outer fingers 52, one of which extends outside each outer core leg portion 14 in accordance with cut-away portions 48 of the horizontal shield 40 and two inner fingers 54, one of which extends between each pair of adjacent core leg portions 14. This shield design results in improved noise attenuation desirable for present industry needs. Noise attenuation may be further increased by completely covering ends 26 of the transformer coils 20 and 22. Note that such closed loop horizontal shields, if improperly insulated, may create a short turn between primary coils 20 and secondary coils 22 which will substantially lower transformer efficiency.

On both ends of each horizontal shield base portion 46 adjacent outer fingers 52 is slot 50 adapted to receive side shields 60 and 62. Side shields 60 and 62 are narrow rectangular strips of non-ferrous conductive material. Side shield 60 additionally provides support for shield ground wire 64 which is connected to both horizontal shields 40 as well as side shield 60. Shield ground wire 64 is received by appropriate connector tabs 66 located on horizontal shields 40. Shield ground wire 64 is connected to side shield 60 by first bolt 68 and first nut 70. At bottom horizontal shield 40 the shield ground wire 64 is connected to the transformer ground wire.

Two barrier shields 72 are placed parallel to leg portions 14 on one side of transformer coils 20 and 22 between adjacent phases of transformer coils 20 and 22. Width 74 of barrier shield 72 is greater than distance between primary vertical shields 32 of adjacent phases. Each barrier shield 72 is comprised of extension 76 which runs the length of longitudinal wall 24 and lips 78 which extend along both edges of the entire length of extension 76. At each end of barrier shield 72 is tab 80 positioned approximately perpendicular to extension 76. Tab 80 includes opening 82 which is aligned with groove 56 located on the end of inner finger 54. Barrier shields 72 are connected to horizontal shields 40 by means of second bolts 84 placed through grooves 56 and openings 82 and secured tightly thereto by second nut 86.

Side shields 60 and 62 and barrier shields 72 also serve to stop RF energy traveling between the power line and earth. The entire transformer assembly comprising core, coils, and shields is surrounded by enclosure 88. Since enclosure 88 is grounded, RF energy travels between the energized portion of transformer 10 and enclosure 88. Barrier shields 72 close the space between adjacent phases of outermost primary vertical shields 32. Side shields 60 and 62 extend beyond longitudinal walls 24 to close the space between primary vertical shields 32 of the two outermost phases and the adjacent wall of enclosure 88. Two top shields 90 are positioned adjacent to and parallel to top yoke portion 16 and extend from one wall of enclosure 88 to the opposite wall. Top shields 90 are positioned on opposite sides of top yoke portion 16, and are connected with one another by straps 91. Two bottom shields 92 are positioned in a similar matter with respect to bottom yoke portion 18. Both ends of top shields 90 and bottom ends 92 are solidly connected to the respective ends of side shields 60 and 62 by appropriate fastening means such as nuts and bolts. The combination of side shields 60 and 62, barrier shields 72, top shields 90 and bottom shields 92 serves to attenuate the higher frequency as discussed previously.

While the invention has particularly been shown and described with reference to the preferred embodiment, it will be understood by those skilled in the art that variations in form, construction and arrangement may be made therein, without departing from the spirit and scope of the invention. All such variations are intended to be covered in the appended claims.

I claim:

1. A shielded multi-phase layer wound electrical transformer comprising:

a magnetic core having a first yoke, a second yoke and a plurality of leg portions, said first yoke joining a first end of each leg portion and said second yoke joining a second end of each leg portion;

a plurality of sets of electrical coils, each of said electrical coils having a longitudinal wall and opposite ends, each of said sets of electrical coils being layer wound about one of said leg portions and providing an innermost coil and an outermost coil;

a plurality of sets of concentric non-ferrous conductive vertical shields, at least one of said vertical shields disposed intermediate each of said innermost coils and each of said outermost coils, at least one of said vertical shields disposed inside each of said innermost electrical coils and at least one of said vertical shield disposed outside each of said outermost electrical coils; and two non-ferrous conductive horizontal shields haivng a top and bottom surface, an insulative material deposited to a predetermined thickness upon said top and bottom surfaces, each horizontal shield positioned adjacent to one end of said electrical coils and generally perpendicular thereto, wherein each of said horizontal shields form an incomplete electrical path around each of said leg portions, wherein each of said horizontal shields comprises a base portion and a plurality of fingers, said base portion lying on one side of a respective first and second yoke, and each of said fingers extending alongside of said leg portion to substantially cover both ends of each set of said coils.

2. An electrical transformer as claimed in claim 1 wherein said transformer additionally comprises:

a barrier shield having opposite ends and opposite sides, said barrier shield connected at opposite ends to said horizontal side shields, said opposite sides of each barrier shield engaging said vertical shields disposed outside adjacent outermost coils.

3. An electrical transformer as claimed in claim 1, wherein said transformer additionally comprises:

an enclosure surrounding said core, coils and shields; and a plurallity of side shields, each side shield engaging both horizontal shields, each of said side shields extending from one of said longituidnal walls approximately to said enclosure.

4. A multi-phase layer wound electrical transformer comprising:

a magnetic core having a plurality of leg portions;

a plurality of electrical coils layer wound on each of said leg portions, each of said electrical coils having a longitudinal wall and two opposite ends; and a non-ferrous shield substantially enclosing each of said coils in a separate compartment, each of said shields comprising a tube assembly and two end assmeblies, each of said end assemblies having a top and bottom surface, and insulative material deposited to a predetermined thickness upon said top and bottom surfaces, each of said end assemblies forming no complete path around any leg portion, wherein each of said end assemblies comprises a base portion and a plurality of substantially parallel fingers, said base portion lying on one side of said leg portions, and each of said fingers extend between said leg portions.

5. An electrical transformer as claimed in claim 4, wherein said plurality of electrical coils comprises an innermost coil and an outermost coil; and said shield tube assembly comprises vertical shields disposed inside the innermost coil, outside the outermost coil, and between the coil layers.

6. An electrical transformer as claimed in claim 2 additionally comprising:

an enclosure completely surrounding said core, coils, vertical shields, horizontal shields and barrier shields; and a non-ferrous side shield extending approximately from one of said vertical shields positioned outside an outermost coil to said enclosure.

7. An electrical transformer as claimed in claim 4 wherein the width of one of said fingers positioned between said leg portions does not exceed the distance between said leg portions.

8. A shielded multi-phase layer wound electrical transformer comprising:

a magnetic core having a plurality of leg portions, a first yoke and a second yoke, said first yoke joining a first end of each leg portion and said second yoke joining a second end of each leg portion;

a plurality of sets of electrical coils, each of said electrical coils having a longitudinal wall and opposite ends, each of said sets of electrical coils being layer wound about one of said leg portions and providing an innermost coil and an outermost coil;

a plurality of sets of concentric non-ferrous conductive vertical shields, one of said vertical shields disposed intermediate each of said innermost coils and each of said outermost coils, one of said vertical shields disposed inside each of said innermost electrical coils and one of said vertical shields disposed outside eachof said outermost electrical coils; and two non-ferrous conductive horizontal shields having a top and bottom surface, an insulative material deposited to a predetermined thickness upon said top and bottom surfaces, each horizontal shield positioned adjacent to one end of said electrical coils and generally perpendicular thereto, wherein each of said horizontal shields comprises a base portion and a plurality of fingers, said base portion lying on one side of a respective first or second yoke, and each of said fingers extending alongside a respective leg portion to substantially cover both ends of each set of said coils, each of the fingers having a width that does not exceed the distance between two adjacent leg portions.

9. A shielded multi-phase electrical transformer as claimed in claim 8 wherein each of said horizontal shields lies completely within a single plane.

10. A shielded multi-phase electrical transformer as claimed in claim 8 wherein the horizontal shield fingers are joined only at the base.

* * * * *